US011612985B2

(12) United States Patent
Giovannini

(10) Patent No.: US 11,612,985 B2
(45) Date of Patent: Mar. 28, 2023

(54) PORTABLE APPARATUS FOR CLEANING SURFACES

(71) Applicant: IBIX S.R.L., Lugo (IT)

(72) Inventor: Caterina Giovannini, Santa Maria In Fabriago (IT)

(73) Assignee: IBIX S.R.L., Lugo (IT)

( * ) Notice: Subject to any disclaimer, the term of this patent is extended or adjusted under 35 U.S.C. 154(b) by 412 days.

(21) Appl. No.: 16/761,629

(22) PCT Filed: Nov. 6, 2018

(86) PCT No.: PCT/IT2018/050216
§ 371 (c)(1),
(2) Date: May 5, 2020

(87) PCT Pub. No.: WO2019/087226
PCT Pub. Date: May 9, 2019

(65) Prior Publication Data

US 2020/0324388 A1 Oct. 15, 2020

(30) Foreign Application Priority Data

Nov. 6, 2017 (IT) ..... 102017000126116

(51) Int. Cl.
*B24C 3/06* (2006.01)
*B24C 7/00* (2006.01)

(52) U.S. Cl.
CPC ..... *B24C 3/06* (2013.01); *B24C 7/0053* (2013.01)

(58) Field of Classification Search
CPC .... B24C 5/04; B24C 7/00; B24C 9/00; B24C 7/0053; B24C 7/0092; B24C 3/06; B24C 11/00; B24C 7/0046; B24C 7/0061; B24C 7/0069; B05B 7/00; B05B 7/0093; B05B 7/02; B05B 7/04; B05B 7/0408; B05B 7/14; B05B 7/1459; B05B 7/24; B05B 7/2472;
(Continued)

(56) References Cited

U.S. PATENT DOCUMENTS 2,025,247 A * 12/1935 Rosenberger ..... B24C 7/0053 138/45
5,319,894 A 6/1994 Shank, Jr.
(Continued)

FOREIGN PATENT DOCUMENTS

BE 564656 A 7/1960
CN 2 260 684 Y 8/1997
(Continued)

*Primary Examiner* — Katina N. Henson
(74) *Attorney, Agent, or Firm* — McGlew and Tuttle, P.C.

(57) ABSTRACT

The portable apparatus for cleaning surfaces comprises a base (3); a tank (2) associated with said base (3) at the top thereof, said tank (2) being predisposed to contain at least one abrasive material. At least one mixing valve (9) is associated with the base (3) and connected with said tank (2) so as to receive said abrasive material contained in said tank (2) and mix said abrasive material with a predetermined amount of compressed air. An adjusting member (11) is associated with the tank (2), said adjusting member (11) being predisposed to enable the selection of a predetermined value indicating the amount of said abrasive material to be mixed with said compressed air in said at least one mixing valve (9).

11 Claims, 2 Drawing Sheets

(58) Field of Classification Search
CPC .. B05B 7/26; B05B 7/28; B05B 7/145; B05B 12/14
USPC ..... 451/99, 446
See application file for complete search history.

(56) References Cited

U.S. PATENT DOCUMENTS

| | | | | |
|---|---|---|---|---|
| 5,605,497 | A | 2/1997 | Pickard | |
| 8,057,279 | B2 * | 11/2011 | Connelly | B24C 3/06 451/39 |
| 2006/0128282 | A1 * | 6/2006 | Grechishkin | B24C 5/00 451/75 |
| 2008/0287039 | A1 | 11/2008 | Connelly | |
| 2014/0065933 | A1 | 3/2014 | Haramboure et al. | |

FOREIGN PATENT DOCUMENTS

| | | | |
|---|---|---|---|
| CN | 105 715 855 | A | 6/2016 |
| EP | 1539424 | B1 | 5/2007 |
| EP | 2 094 442 | B1 | 5/2011 |

* cited by examiner

PORTABLE APPARATUS FOR CLEANING SURFACES

TECHNICAL FIELD

The present invention relates to a portable apparatus for cleaning surfaces, in particular of artefacts, buildings, architectural elements and the like.

BACKGROUND ART

It has long been known the use of apparatuses for cleaning surfaces through a process known as sandblasting.

The sandblasting consists in propelling a jet of compressed air and abrasive material on the surface to be treated to remove the superficial layer of material. Alternatively, sandblasting can be used for creating inscriptions or images on marble, stone, wood or glass.

Traditional cleaning apparatuses comprise a tank for abrasive material connected, through a mixing valve, to a mixing chamber in which a predetermined flow of compressed air, generally produced by a compressor, is conveyed.

The mixing valve is placed underneath the tank to receive the abrasive material which is discharged into a passage channel defined in the valve in order to be then conveyed to the mixing chamber. A shutter is associated with the mixing valve, which is located at the passage channel, and is actuated by an adjusting member which is connected to the shutter. The adjusting member enables the adjustment of the amount of the abrasive material coming from the tank and required to be mixed to the compressed air flow.

A sprayer gun provided with commands for spraying, through a suitable nozzle, a jet of air and abrasive material is connected with the mixing chamber by connection means.

Examples of this type of cleaning apparatuses are illustrated in applications US 2014/0065933 and U.S. Pat. No. 5,319,894.

A problem often complained in the field is that the operator, in order to adjust the amount of abrasive material to be mixed to the flow of compressed air, have to lower himself so that to access the mixing valve which is below the tank. This position is inconvenient and uncomfortable for the operator.

It must also be considered that in many situations it is necessary to perform the adjustment frequently, for example when the operator has to establish the optimal composition of the mixture of abrasive material and compressed air to be used for the treatment. In such cases the operations of lowing himself and adjusting the material by the adjusting member are repeated almost in sequential way, causing a waste of time and the operator's fatigue.

The discomfort for the operator is greater when only one operator is expected to operate the apparatus and therefore the operator have to alternate between the raised position assumed for spraying the mixture and the lowered position required to adjust the abrasive material.

Cleaning apparatuses provided with the devices for adjusting the quantity of supplied abrasive material are shown in U.S. Pat. No. 2,025,247, BE 564656 e U.S. Pat. No. 5,605,497.

EP 1539424 discloses a cleaning apparatus provided with a switch member predisposed to controlling the opening or closing of a sprayer nozzle; the aforesaid switch member can be controlled by an electrical, mechanical, pneumatic or hydraulic control circuit.

Still, the known solutions do not facilitate manual operations for adjusting the amount of abrasive material. Also, the same solutions do not enable the manual implementation of a fine adjustment, which is reliable and repeatable for the operator.

DISCLOSURE

The object of the present invention is to solve the aforementioned problems by devising an apparatus that enables cleaning of surfaces ensuring a comfortable use for the operator.

As part of this task, a further objective of the present invention is to provide a cleaning surfaces apparatus that enables the optimal adjustment of the abrasive material.

A further object of the invention is to provide a cleaning surfaces apparatus that enables the operating times required to perform the treatment to be reduced.

A further object of the invention is to provide a cleaning surfaces apparatus of simple construction concept, that is functional and definitely reliable in operation and of relatively cheap cost.

The abovementioned objects are achieved, according to the present invention, by the portable apparatus for cleaning surfaces according to claim 1.

The portable apparatus for cleaning surfaces includes a base, a tank associated with said base at the top thereof, said tank being predisposed to contain at least one abrasive material; at least one mixing valve associated with said base and connected to said tank in order to receive said abrasive material contained in said tank and mix said abrasive material with a predetermined amount of compressed air; an adjustment member configured to enable the selection of a value indicating the amount of the abrasive material to be mixed with said compressed air in said at least one mixing valve; a shutter device associated with said at least one mixing valve; a drive means predisposed to connect said adjusting member (11) with said shutter device (10), said shutter device (10) being predisposed to be operated remotely by said adjusting member (11), through said drive means (12), to vary the amount of said at least one abrasive material to be mixed with said flow of compressed air of a value proportional to said value indicating the amount of said abrasive material.

Said drive means, according to the invention, comprises a drive shaft associated at one end with said adjusting member, said drive shaft being operated in rotation by said adjusting member about a first, preferably substantially longitudinal, axis. The drive shaft is associated at the opposite end with a gear assembly predisposed to transmit motion from said drive to the shutter device, in order to easily enable the manual adjusting operations.

It must be considered that the connection of the adjusting member to the shutter device by the drive means enables the shutter device to be remotely operated and achieve a more comfortable use of the apparatus for the operator.

Preferably, the adjusting member is arranged at the upper portion of said tank, at a sufficient distance from said base in order to enable a convenient use of said adjusting member.

According to an aspect of the invention, the adjusting member is associated with the tank at the top thereof. Thus, the operator can easily access the adjusting member and can assume a correct position during use, especially in a phase of adjusting the abrasive material.

Preferably, the adjusting member is mounted on a support member associated with closing means, said closing means being predisposed to close at the top said tank.

Preferably, said adjusting member comprises a rotary knob provided with a numerical scale predisposed to enable the setting of said value indicating said amount of said abrasive material to be mixed with said compressed air in said at least one mixing valve.

Preferably, said knob is rotatable around a first axis, which is substantially longitudinal.

Preferably, said drive shaft extends along the entire length of said tank along a direction substantially parallel to the tank.

Preferably, the mentioned first axis is arranged outside the tank.

Preferably, to said support member is connected a tightening member predisposed to be operated so as to prevent the modification of the angular position of the drive shaft, set by the knob, due to any external strain.

Preferably, said gear assembly comprises orthogonal axes gears predisposed to transmit the rotation motion from an input shaft, substantially coaxial to said drive shaft, to an output shaft, associated with said shutter device, said output shaft being operated in rotation about a second transversal axis, preferably substantially orthogonal to said first axis.

The aforementioned gears are preferably of the helical type.

Advantageously, said gear assembly, compared to solutions proposed in prior art, enables an optimum transmission of the adjustment motion, which results in reduced wear of the components.

In particular, the aforementioned gear assembly, made up, for example, of a pair of bevel gears, enables the use of commercial pieces, which are easy to find and at a low cost.

Preferably, said mixing valve internally shapes a passage channel predisposed to enable said abrasive material to be transported from said tank to a mixing chamber, said mixing chamber being predisposed to receive said abrasive material and said flow of compressed air, said second axis extending in a direction transverse to said passage channel and intercepting said passage channel.

Advantageously, said shutter device comprises a shutter member associated with said output shaft of said gear assembly, said shutter member being movable along said second axis so as to modify the cross-section of said passage channel of said mixing valve, the level of occlusion of said passage channel being proportional to said value indicating the amount of said abrasive material.

Preferably, said shutter device comprises a guide member associated with said mixing valve and shaping a guide channel predisposed to receive said shutter member, said shutter member being connected with said output shaft of said gear assembly through a helical coupling and being locked to rotation in said guide channel by connection means predisposed to connect said shutter member with said guide member so that said shutter member moves with linear motion along said second axis.

According to an aspect of the invention, said guide member is provided with a sleeve coaxial to said guide channel, said sleeve defining an opening at which there is fixed a connecting element of the guide member with said shutter member.

Preferably, said connecting element consists of a pin adapted to block rotationally said shutter member, producing linear motion of said shutter member along the second axis. In practice, the shutter member is substantially unscrewed or tightened at the helical coupling with the consequent forward or backward movement along said second axis, which causes a corresponding degree of occlusion of said passage channel of the abrasive material.

DESCRIPTION OF DRAWINGS

Details of the invention shall be more apparent from the detailed description of a preferred embodiment of the portable apparatus for cleaning surfaces according to the invention, illustrated by way of example in the attached drawings, wherein.

BEST MODE

Figure 1:
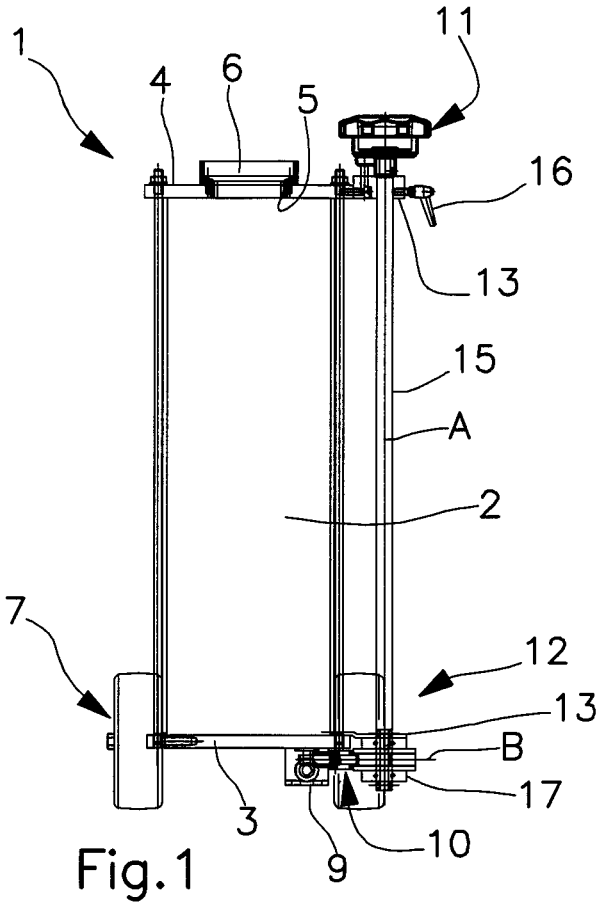
FIG. 1 and FIG. 2 respectively show a front view and a side view of the apparatus for cleaning surfaces according to the present invention.
Figure 2:
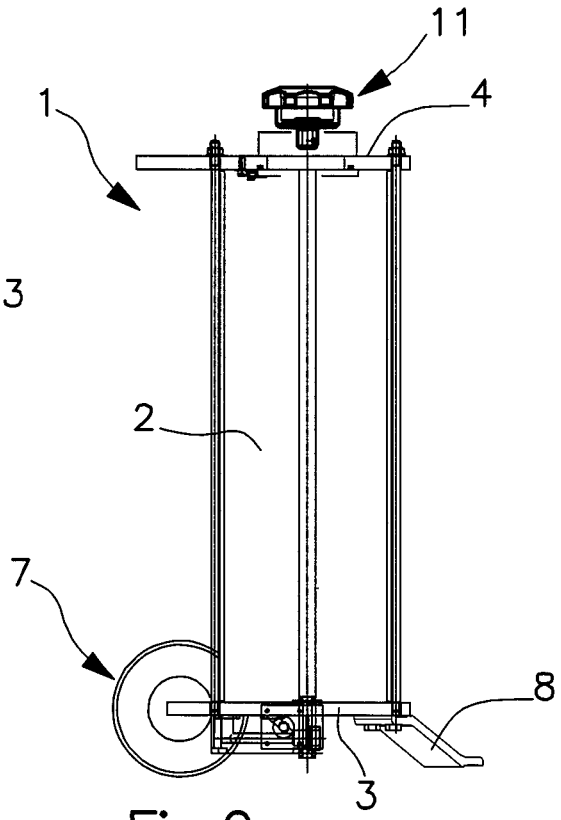
Figure 3:
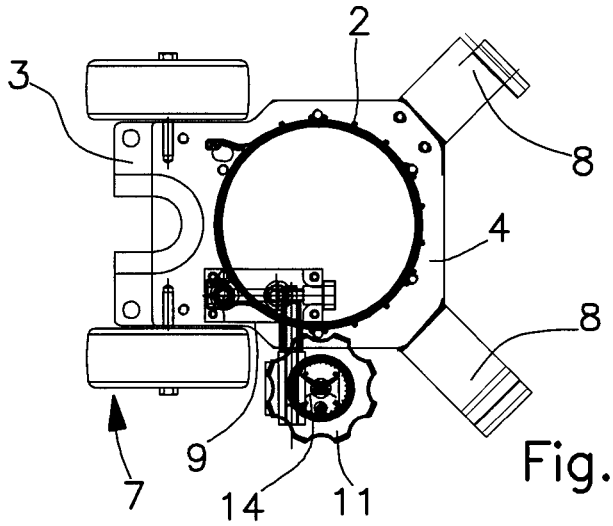
FIG. 3 is a top view of the apparatus that shows some components of the apparatus in transparency.

With particular reference to such figures, the portable apparatus for cleaning surfaces according to the present invention has been indicated in its entirety with 1.

The apparatus 1 comprises a tank 2 associated with a base 3 and it is closed at the top by a closure means 4, such as a lid.

In particular, the tank 2 is mounted at the top of the base 3.

The tank 2 includes a preferably cylindrical or prismatic body and is adapted to receive at least one abrasive material through a refill opening made on the lid 4. A covering element 6, removable in case the material must be loaded in the tank 2, is arranged above the refill opening 5.

Abrasive materials can be, for example, mineral or vegetal or metal ferrous materials.

Carbonates can be used as well, like sodium bicarbonate.

Preferably, the base 3 and the lid 4 are made of shaped plates of light material, for example of aluminium.

Preferably, a moving means 7 predisposed to enable easy device displacement in the workspace is mounted on the base 3. Preferably, the moving means 7 includes a couple of wheels.

The base 3 can be provided as well with support feet 8 in order to stabilise the apparatus when it is placed resting on the floor or on a workbench.

At least one mixing valve 9, connected with the tank 2 by a discharge opening not visible in the figures, is associated with the base 3.

The mixing valve 9 is predisposed to receive an abrasive material from the tank 2, to which is connected, and to mix the abrasive material with a predetermined amount of compressed air displaced into the valve by a compressed air conduction circuit, not represented.

Compressed air is provided by a compressor and conveyed by a supply circuit, both not represented, to the conduction circuit associated with the apparatus 1.

The mixing valve 9 is provided with a nozzle adapted to be connected to the sprayer means, which preferably comprises a sprayer gun in order to supply a flow of compressed air and at least one abrasive material.

The mixing valve 9 includes a mixing chamber, not shown in the figures, wherein the flow of compressed air and the abrasive materials are conveyed. The abrasive material is displaced from the tank 2 to the mixing chamber by a passage channel 90 internally shaped by the valve.

The mixing valve 9 is associated with a shutter device 10 predisposed to be operated by an adjusting member 11 by drive means 12 in order to modify the amount of the abrasive material to be mixed to the compressed air flow.

In practice, the shutter device 10 operates on the passage channel 90 by varying the channel section and, as a result, the amount of abrasive material that is mixed to the compressed air flow.

The adjusting member 11 is associated with the tank 2.

Preferably, the adjusting member 11 is associated with the tank 2 at its top.

Alternatively, the adjusting member 11 is associated with an upper portion of the tank 2 and arranged at a distance from the base 3 sufficient to enable a convenient use of the adjusting member 11 by the operator.

For example, the adjusting member 11 may occupy a position corresponding to half height of tank 2 or the adjusting member 11 is placed at the height of the lid 4 tank 2.

According to the embodiment shown in the figures, the adjusting member 11 is mounted on the support member 13 connected to the lid 4.

The support member 13 may be made up of a plate fixed to the lid 4 by a connection means such as screw means.

Preferably, the adjusting member 11 comprises a knob provided with a numerical scale 14 predisposed to enable the setting of a value indicating the amount of the abrasive material to be mixed with the compressed air in the mixing valve 9.

Preferably, the knob 11 is rotatable around a first axis, which is substantially longitudinal.

The knob 11 is connected to the drive means 12.

The drive means 12 comprises a drive shaft 15 associated at one end with the knob 11 predisposed to be operated in rotation around a first axis A by operating the knob 11.

The drive shaft 15 is jointly connected to the knob 11 and is passing through a hole carried out on a support member 13.

A tightening member 16 is connected to the support member 13 and adapted to be operated in order to prevent the modification of the angular position of the drive shaft 15, set by the knob 11, due to any external strain.

Preferably, the drive shaft 15 extends along the entire length of the tank 2 along a substantially parallel direction respect to the tank 2.

The drive shaft 15 is associated at the opposite end to a gear assembly 17 predisposed to displace the motion from the drive shaft 15 to the shutter device 10.

The gear assembly 17 is supported by a further support member 13 attached to the tank 2 at the base 3.

Preferably, the gear assembly 17 includes orthogonal axes gears predisposed to displace the rotation motion from an input shaft, essentially coaxial to the drive shaft 15, to the output shaft, which is associated with the shutter device 10.

Preferably, the gears are of helical type.

The output shaft is operated rotationally around a second axis B, which is essentially orthogonal to the first axis A.

The second axis B extends in a transversal direction in relation to the passage channel 90 of the mixing valve 9 and intercepts such passage channel 90.

Preferably, the gear ratio of the gear assembly 17 is 1:1.

The shutter device 10 includes an actuating member 18 adapted to move along the second axis B so as to modify the section of the passage channel 90 of the mixing valve 9, as will be explained below.

The actuating member 18 is connected to the output shaft of the gear assembly 17 by a helical coupling. More precisely, the actuating member 18 has a threaded portion **18*a*** predisposed to coupling to a corresponding threaded portion of the output shaft.

The shutter device 10 also includes a guide member 19 associated to a mixing valve 9 and essentially aligned to the output shaft along a parallel direction to the axis B.

The guide member 19 internally shapes a guide channel 20, which extends for the entire length of the guide member 19 itself and is predisposed to receive the actuating member 18.

Figure 4:
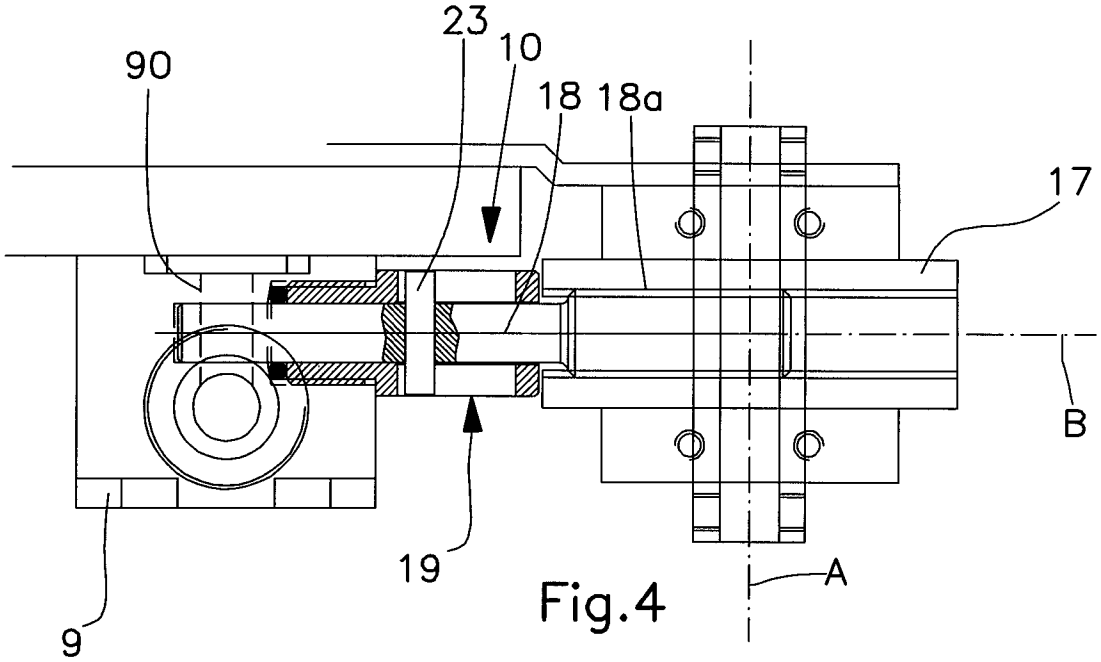
FIG. 4 shows an enlarged detail of the apparatus.
Figure 6:
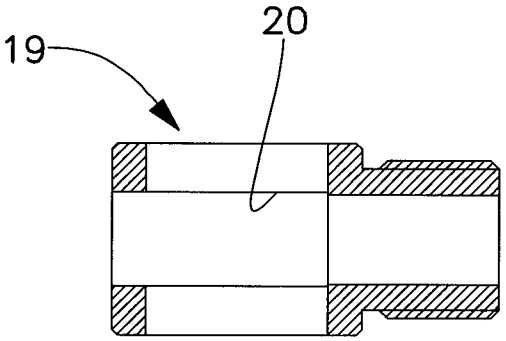
FIGS. 5 and 6 show respectively a top view and a longitudinal section view of a detail of the apparatus.
Figure 5:
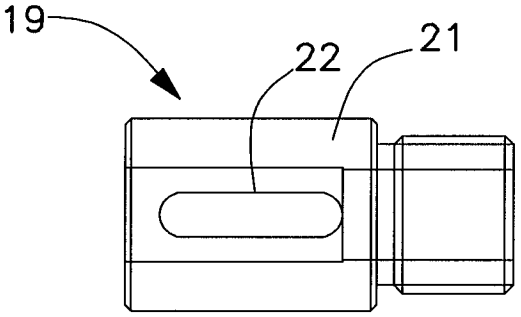

The guide member 19 is provided with a sleeve 21 coaxial to the guide channel 20. The sleeve 21 defines an opening 22 at which is attached a connecting element 23 of the guide member 19 with the actuating member 18 (see FIG. 4, FIG. 5 and FIG. 6).

The connecting element 23 may consist of a pin.

Preferably, the opening 22 forms a slot predisposed to defining the maximum and minimum stroke of the actuating member 18 along the second axis B.

Said connecting element 23 has the effect of locking the rotation of the actuating member 18 causing linear motion of the actuating member 18 along the second axis B in either direction depending on the direction of rotation set by the operator at the knob 11. In practice, this causes the actuating member 18 to be basically unscrewed or tightened in the threaded portion **18*a* resulting in a forward or backward movement along the mentioned axis B that causes a corresponding occlusion degree of the abrasive material passage channel 90**.

The operation of the portable apparatus for cleaning surfaces is easily understandable from the above description.

Initially, the operator shall pour at least an abrasive material in the tank 2 through the refill opening 5.

The operator shall subsequently adjust the amount of abrasive material to be mixed to the flow of compressed air The knob 11 is then turned until a predetermined numerical scale value 14 is selected.

The rotation of the knob 11 is passed to the drive shaft 15, which in turn passes the motion to the gear assembly 17.

The actuating member 18 is moved by the gear assembly 17 and, thanks to the interposition of the guide member 19 and of the connecting element 23, moves along the axis B, modifying the section of the passage channel 90 of the mixing valve 9. The magnitude of the occlusion level of the channel 90 is proportional to the value set on the numerical scale.

When the compressor is operated, the compressed air is conveyed from the conduction circuit to the mixing valve 9, so as to mix the compressed air flow with the abrasive material.

The operator then activates the sprayer gun in order to direct the flow of compressed air and at least one abrasive material mixed together towards the surface to be treated.

The operator can operate the tightening member 16 to ensure that the angular position of the drive shaft 15 is not changed and thus that this position is permanently maintained.

In the event that the operator has instead the need to change the amount of abrasive material, he repeats the turning knob 11 operation until a predetermined desired value of the numerical scale 14 is selected.

The operator can easily move the apparatus thanks to the couple of wheels 7, by placing it in the most convenient place for performing the treatment.

Portable apparatus for cleaning surfaces achieves the desired object of cleaning surfaces ensuring a comfortable use for the operator.

This object is achieved by providing the connection of the adjusting member with the shutter device of the valve by the drive means so as to be able to remotely actuate the shutter device, achieving thereby greater convenience for the operator.

An aspect to be considered is that the adjusting member is preferably arranged above the tank or in any case at the upper portion of the tank, at a sufficient distance from the base. Thus, the adjusting member is made easily accessible and an ergonomic apparatus is obtained, since it is possible to assume a correct position during use, particularly in the phase of adjustment of the abrasive material.

The operator is not required to assume an inconvenient position to adjust the abrasive material but, on the contrary, can comfortably access the adjusting member without changing its standing position or bending down slightly. The adjustment can be optimally performed.

In addition, the ability to easily adjust the amount of abrasive material to be mixed to flow of compressed air accelerates the cycle time required for performing the treatment, especially when one needs to perform several tests of treatment with different quantities of mixed material.

A further characteristic of the invention is that the ability to select a value indicating the amount of abrasive material to be mixed with the compressed air in the mixing valve, due to the numerical scale of the adjustment member, enables to achieve greater precision and reproducibility of the treatments. In fact, once the optimum amount of abrasive material to be mixed with the compressed air flow for a predetermined treatment is defined, the operator may write down the corresponding numeric value of the scale he selected. It thus makes it possible to detect reference values for mixtures to be supplied in case of different treatments. For example, treatments can be defined in terms of characteristics of the surfaces to be treated and the results to be obtained with the treatment. Reference tables can then be defined for the operators, which provide greater repeatability since the value or range of values that are recommended to perform a predetermined treatment is known. The definition of a value or range of values for the quantity of abrasive material to be mixed to the flow of compressed air also makes it possible to reach a greater level of precision. Finally, it is to be observed that the operator benefits from use of the apparatus, according to the present invention, in terms of physical well-being since he is not required to assume an inconvenient position and undergoes a minor fatigue.

The described apparatus by way of example is subject to numerous modifications and variations based on need.

In the practical implementation of the invention, the materials used, as well as the shape and size, may vary depending on needs.

Should the technical features mentioned in any claim be followed by reference signs, such reference signs were included strictly with the aim of enhancing the understanding of the claims and hence they shall not be deemed restrictive in any manner whatsoever on the scope of each element identified for exemplifying purposes by such reference signs.

The invention claimed is:

1. A portable surface cleaning apparatus comprising:

a base;

a tank associated with said base at a top thereof, said tank being configured to contain at least one abrasive material;

at least one mixing valve associated with said base and said at least one mixing valve being connected with said tank so as to receive said abrasive material contained in said tank and mix said abrasive material with a predetermined amount of compressed air;

an adjusting member configured to enable a selection of a predetermined value indicating an amount of said abrasive material to be mixed with said compressed air in said at least one mixing valve;

a shutter device associated with said at least one mixing valve; and a drive means for connecting said adjusting member with said shutter device, said shutter device being operable remotely by said adjusting member, through said drive means, in order to vary said amount of said at least one abrasive material to be mixed with a flow of said compressed air of a value proportional to said value indicating said amount of said abrasive material, said drive means including a drive shaft associated with an end of said adjusting member, said drive shaft being operable in rotation by said adjusting member around an axis, in order to perform manually adjusting operations of said amount of said at least one abrasive material to be mixed, said drive shaft being associated at an opposite end with a gear assembly configured to transmit a motion from said drive shaft to said shutter device, wherein said axis, around which said drive shaft is operable in rotation, is basically longitudinal to said apparatus, said gear assembly comprising orthogonal axes gears configured to transmit a rotation motion from an input shaft, substantially coaxial to said drive shaft, to an output shaft, associated with said shutter device, said output shaft being operable in rotation about another axis traversing said axis.

2. The apparatus according to claim 1, wherein said adjusting member comprises a rotary knob provided with a numerical scale configured to enable setting of said value indicating said amount of said abrasive material to be mixed with said compressed air in said at least one mixing valve, so that precision and reproducibility of a cleaning process is achieved by a user.

3. The apparatus according to claim 1, wherein said axis is placed outside of said tank.

4. The apparatus according to claim 1, wherein said another axis is substantially orthogonal to said axis.

5. The apparatus according to claim 4, wherein said mixing valve internally shapes a passage channel configured to enable said abrasive material to be transported from said tank to a mixing chamber, said mixing chamber being configured to receive said abrasive material and said flow of compressed air, said another axis extending in a transverse direction in relation to said passage channel and said another axis intercepting said passage channel.

6. The apparatus according to claim 1, wherein said mixing valve internally shapes a passage channel configured to enable said abrasive material to be transported from said tank to a mixing chamber, said mixing chamber being configured to receive said abrasive material and said flow of compressed air, said another axis extending in a transverse direction in relation to said passage channel and said another axis intercepting said passage channel.

7. The apparatus according to claim 6, wherein said shutter device comprises a shutter member associated with said output shaft of said gear assembly, said shutter member being movable along said another axis so as to modify a section of said passage channel of said mixing valve, wherein a level of occlusion of said passage channel is proportional to said value indicating said amount of said abrasive material.

8. The apparatus according to claim 7, wherein said shutter device comprises a guide member associated with said mixing valve and shaping a guide channel configured to receive said shutter member, said shutter member being connected with said output shaft of said gear assembly through a helical coupling and said shutter member being locked to rotation in said guide channel by a connecting means for connecting said shutter member with said guide member so that said shutter member moves with linear motion along said another axis.

9. The apparatus according to claim 1, wherein said adjusting member is arranged at an upper portion of said tank, at a distance from said base to enable a comfortable use of said adjusting member.

10. The apparatus according to claim 1, wherein said adjusting member is mounted on a support member associated with a closure means, said closure means being configured to close at the top of said tank.

11. The apparatus according to claim 10, wherein said support member is associated with a tightening member such as to block an angular position of said drive shaft.

* * * * *